US006123257A

United States Patent [19]

Guidicy

[11] Patent Number: 6,123,257

[45] **Date of Patent: *Sep. 26, 2000**

[54] MASONRY MAILBOX ASSEMBLY WITH REPLACEABLE MAILBOX INSERT AND METHOD OF CONSTRUCTING SAME

[76] Inventor: Gregory J. Guidicy, 5002 Scenic Wood Dr., Imperial, Mo. 63052

[ * ] Notice: This patent issued on a continued prosecution application filed under 37 CFR 1.53(d), and is subject to the twenty year patent term provisions of 35 U.S.C. 154(a)(2).

[21] Appl. No.: 09/034,852

[22] Filed: Mar. 4, 1998

[51] Int. Cl.[7] ..... G65D 91/00

[52] U.S. Cl. ..... 232/17; 232/39; 232/45

[58] Field of Search ..... 232/17, 45, 38, 232/39, 33, 29; D99/29–33

[56] References Cited

U.S. PATENT DOCUMENTS

| | | | |
|---|---|---|---|
| D. 360,741 | 7/1995 | Bohlmann . | |
| D. 365,189 | 12/1995 | Dennis . | |
| 4,181,250 | 1/1980 | Withrow | 232/44 |
| 4,333,603 | 6/1982 | Carlson | 232/33 X |
| 4,600,143 | 7/1986 | Harlow, Jr. et al. . | |
| 4,848,650 | 7/1989 | Roberts, II | 232/43.4 X |
| 4,875,622 | 10/1989 | Lents | 232/39 |
| 4,932,587 | 6/1990 | Robbins . | |
| 5,361,977 | 11/1994 | Ogrodnick, Jr. | 232/39 |
| 5,411,206 | 5/1995 | Latham et al. . | |
| 5,425,501 | 6/1995 | Wesorick . | |
| 5,454,509 | 10/1995 | Bellamy et al. | 232/39 X |
| 5,524,818 | 6/1996 | Patry et al. | 232/35 |
| 5,575,422 | 11/1996 | Peterman . | |
| 5,595,341 | 1/1997 | Robinson et al. . | |
| 5,597,116 | 1/1997 | Morris . | |
| 5,607,103 | 3/1997 | Boling, Jr. . | |

*Primary Examiner*—Lynne H. Browne
*Assistant Examiner*—Wiiliam L. Miller

[57] ABSTRACT

A masonry mailbox assembly including a masonry shell, a mailbox liner encased within the shell and a mailbox insert disposed within the mailbox liner. The mailbox insert can be removably secured within the mailbox liner so that the mailbox can be replaced without dismantling the masonry shell. Also disclosed is a mailbox face for use as the mailbox insert in place of a complete mailbox. the mailbox face includes a mailbox door pivotally mounted to a flange and can be used to repair existing masonry mailboxes with a damaged mailbox insert.

19 Claims, 3 Drawing Sheets

MASONRY MAILBOX ASSEMBLY WITH REPLACEABLE MAILBOX INSERT AND METHOD OF CONSTRUCTING SAME

BACKGROUND OF THE INVENTION (1) Field of the Invention

The present invention relates generally to masonry mailboxes and specifically to masonry or brick mailbox assemblies having an outer shell, an interior liner and a mailbox insert.

(2) Description of the Related Art

It is well known in the art to build a mailbox consisting of a raised post secured in the ground with a mailbox mounted on top of the post. The mailboxes are usually placed near the shoulder of a road or highway so that a carrier can stay in the mail vehicle and need not traverse down private roads or driveways to deliver the mail. The placement of mailboxes near roads or highways has caused an increasing problem with mailbox vandalism and the destruction of mailboxes. For example, automobiles collide with or run into mailboxes thereby causing damage.

In addition, the proximity of the mailboxes to a road allows vandals to strike mailboxes by merely leaning out of a car window while driving by a mailbox. This also provides a quick get-away thereby reducing the likelihood of catching the vandal which further encourages mailbox vandalism. Mailboxes are also continuously exposed to the environmental elements and are prone to rust and corrode. As a result of the rust and corrosion, standard mailboxes may require frequent painting and repairs to keep the mailbox in a functional capacity.

In response to increased incidents of damage with mailboxes, and to protect mailboxes from the elements, many prior art devices have been developed in an attempt to construct mailboxes from such a material and in such a form that are less susceptible to damage when being struck by a vandal or a vehicle. One of the most effective of these types of mailboxes are those constructed from masonry and/or brick. In this way, the standard mailbox made of metal or plastic is encased in brick or masonry thereby providing a protective shell around the mailbox. Throughout this specification and claims the word "masonry" will be used to refer to any rigid structure which is used to encase a standard mailbox, including brick and mortar, concrete, and any other similar equivalent type of material which provides a rigid outer shell.

When a masonry mailbox is built, it is customary to use a complete standard mailbox, made of metal or plastic, within the masonry shell. This provides an enclosure having a door within the masonry shell to receive and keep mail. By using a complete mailbox, the user has all of the attributes of a standard mailbox with the extra security and strength provided by a masonry shell. When masonry mailboxes are built in this way, it is common for the cement, mortar or other adhesive to adhere to the mailbox insert thereby making it difficult, if not impossible, to remove the mailbox insert after the mailbox assembly is complete without dismantling at least a portion of the masonry shell.

In most instances, a masonry mailbox decreases the likelihood of destruction of the mailbox because the force required to break through the masonry casing is greater than that usually supplied by a vandal striking a mailbox. However, although masonry mailboxes can better withstand the rigors of vandals and the elements than metal of plastic mailboxes, other problems have developed with the use of masonry mailboxes. One such problem is the additional material, such as brick and/or cement, adds to the cost to construct the mailbox. In addition, most home owners cannot construct a masonry mailbox on their own and must hire a mason to build or repair such a mailbox. Also, building a masonry mailbox takes more time and effort than it does to put up a post with a metal or plastic box thereon.

Another problem is that when encasing the mailbox in masonry for protection, it is difficult if not impossible to maintain the mailbox insert such as by painting. Inevitably, moisture enters between the mailbox insert and the masonry shell at the ends thereby causing rust to form thereon. This causes deterioration of the metal and the door hinges.

Another disadvantage with masonry mailboxes is the difficulty encountered in repairing or replacing the metal or plastic mailbox insert encased in the masonry shell when necessary. Over time, either due to wear and tear, or outdoor conditions, the mailbox insert within the masonry shell can rust and otherwise deteriorate. Also, such a mailbox insert is still susceptible to vandalism and damage even though it is encased in a masonry shell. Although more difficult to vandalize, the door of a metal or plastic mailbox insert within the masonry shell can still be removed by vandals or by accident.

Thus, although masonry mailboxes provide additional protection from vandals or collisions, a vandal can still tear the door off or rust and corrosion can deteriorate the mailbox insert. Unfortunately, because a masonry mailbox encases the entire plastic or metal mailbox insert, one must dismantle at least a portion of the masonry in order to replace or repair the mailbox insert. This is a result of there being no easy way to remove an existing mailbox insert and install a new mailbox insert into a masonry shell and no readily available apparatus which can be easily and quickly attached to an existing mailbox insert. Even if the existing insert could be removed, the standard types and kinds of mailboxes which are readily available cannot be easily inserted within the masonry shell due to the close fit that is usually provided between the old mailbox insert and the masonry shell.

Therefore, when a mailbox insert within a masonry shell is damaged or deteriorates, the masonry shell must be sufficiently dismantled in order to replace the mailbox insert. When this occurs, the average lay person cannot perform this type of repair work and is required to hire a mason thereby increasing the cost of repairs. Thus, the act of removing a worn or damaged mailbox insert and replacing it with a new mailbox insert becomes very cumbersome and can be expensive if a bricklayer, mason or other professional must be hired to do the work.

Thus, what is needed is a method and apparatus which allows an average lay person having a damaged or deteriorated mailbox insert within a masonry shell to easily and quickly repair or replace the mailbox insert without the time and expense required to dismantle the masonry shell.

SUMMARY OF THE INVENTION

The present invention provides a solution to the above-referenced problems. The present invention comprises a masonry mailbox assembly which includes a mailbox liner encased in the masonry shell and the mailbox liner is adapted to allow the replacement a mailbox insert without dismantling any portion of the masonry shell. When building the masonry mailbox assembly of the present invention, the mailbox liner, made of a suitable material, is encased within the masonry shell in lieu of a standard mailbox.

The mailbox liner can be of any shape or size provided that it is capable of receiving a mailbox insert therein and provided it is capable of keeping the masonry shell mortar or cement from adhering to the sides of the mailbox insert. The masonry shell and the mailbox liner each have an opening to allow the mailbox insert to be removed from and inserted into the liner. The mailbox insert can be secured within the liner using screws, glue or other equivalent fasteners so that it cannot be removed without the aid of tools.

In this way, a masonry mailbox owner faced with a damaged or deteriorated mailbox insert, can merely purchase a new mailbox insert, including a readily available standard mailbox, remove the old mailbox insert and replace it with the new mailbox insert without dismantling the masonry shell. The entire procedure takes very little time and expense and can be completed by the average lay person without hiring a mason or bricklayer. In fact, the procedure can be performed by a person with little or no technical skill or knowledge.

Another aspect of this invention is to provide for an even simpler and less expensive replacement mailbox insert. This is provided by combining the liner discussed above with a replaceable mailbox face. The replaceable mailbox face comprises a door pivotally attached to a flange, the flange being adapted to allow attachment of the flange to an open end of the liner. The flange can either be disposed within the open end of the mailbox liner or around the outside of the circumference of the mailbox liner to thereby provide a replacement door for the mailbox insert. The combination of the mailbox face with a mailbox liner converts the liner for use as a complete mailbox. When used in this fashion, the interior volume of the mailbox liner acts as the body of a mailbox and the mailbox face, attached to an open end of the liner, acts as the mailbox insert door. This allows a user to repair a damaged mailbox insert without having to purchase an entire additional mailbox and without dismantling an existing masonry shell. The present invention thereby further reduces the time and expense that must be undertaken to replace a mailbox insert encased in a masonry shell. The mailbox face can be adapted to be used with existing mailboxes or used with the masonry mailbox assembly of the present invention.

DETAILED DESCRIPTION OF THE PREFERRED EMBODIMENT

Figure 1:
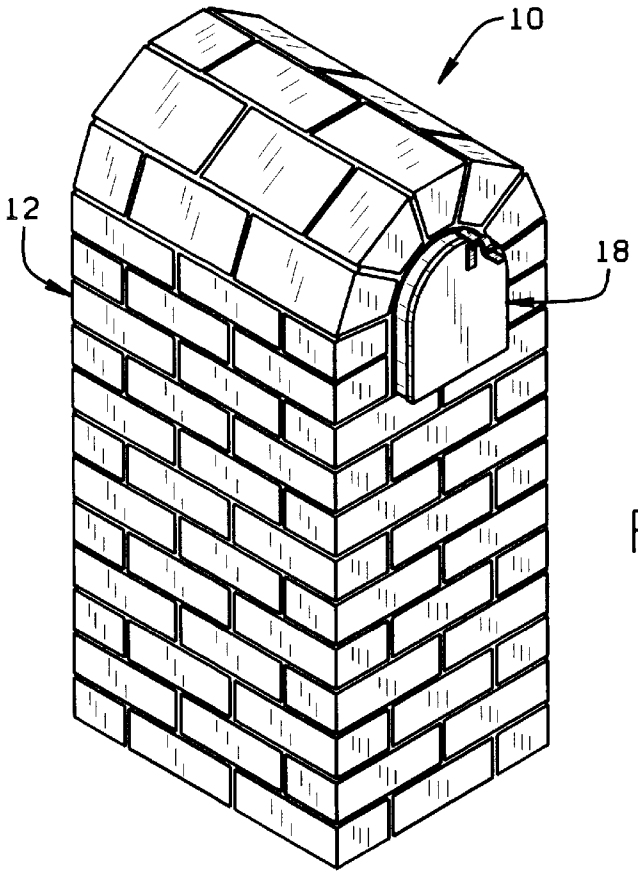
FIG. 1 shows the masonry mailbox assembly of the present invention fully assembled.
Figure 2:
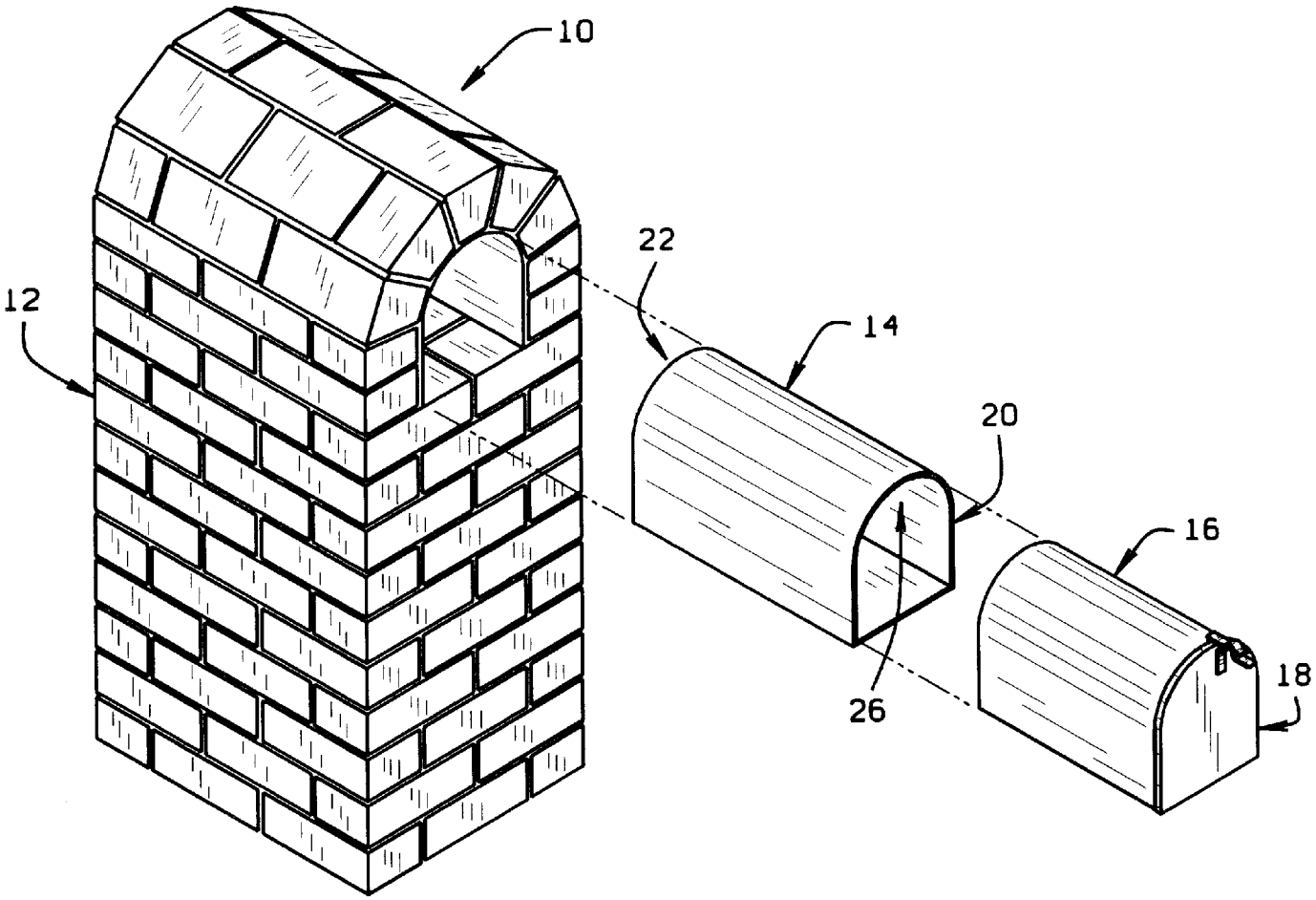
FIG. 2 shows an exploded view of the masonry mailbox assembly of FIG. 1, showing the masonry shell, mailbox liner and a complete mailbox insert of the present invention

The masonry mailbox assembly of the present invention is shown generally as 10 in FIGS. 1 and 2. As shown, a masonry shell 12 of the preferred embodiment is constructed of brick and mortar and has a typical shape and size as is known in the art. The masonry shell 12 is assembled around a mailbox liner 14. Within the mailbox liner 14 is a complete mailbox insert 16 having a hinged door 18 attached thereto.

It should be noted that the masonry shell, the mailbox liner and mailbox insert of the present invention can be of any shape and size without departing from the spirit of the invention. The only requirement is that the mailbox liner be adapted to securely fit within the masonry shell and the mailbox insert be adapted to be removably connected within the mailbox liner.

The masonry shell 12 of the preferred embodiment can be made of any rigid material to provide protection to the mailbox liner 14 and mailbox insert 16, including brick and mortar, cement, concrete or other equivalent material. The masonry mailbox assembly 10 of the preferred embodiment is assembled as is known in the art, with the exception of encasing the mailbox liner 14 directly adjacent the masonry shell 12 in place of the usual complete mailbox insert 16. The masonry shell 12 and mailbox liner 14 should each have at least one opening to allow the insertion of a mailbox insert 16 therein. In the preferred embodiment, the mailbox liner 14 has two open ends 20 and 22 to allow ease of manufacturing and use. Also, this allows the liner to be used in conjunction with masonry mailboxes having dual openings, as is known in the art, to allow the mail to be retrieved from either side of the mailbox assembly.

Figure 4:
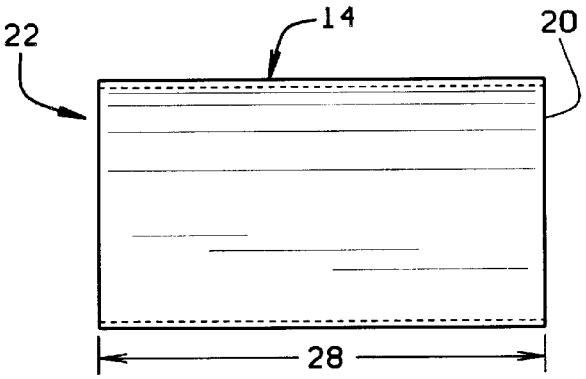
FIG. 4 shows a side view of the mailbox liner of the present invention.
Figure 3:
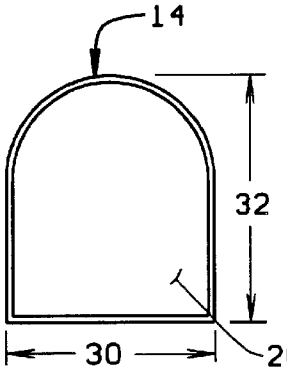
FIG. 3 shows a cross section of the mailbox liner of the pr sent invention.

The mailbox liner 14 of the present invention is shown in detail in FIGS. 3–4. As shown, the mailbox liner 14 can be of any shape and size as long as it is adapted to receive within its interior volume a mailbox insert 16 having a specifically desired of desired shape and size. Although only one shape of mailbox liner 14 and mailbox insert 16 are shown in the drawings, the mailbox liner 14 and mailbox insert 16 can be of any desired shape without departing from the present invention. In the preferred embodiment, the mailbox liner 14 is adapted to receive a standard mailbox as the mailbox insert 16 within its interior volume.

Figure 5:
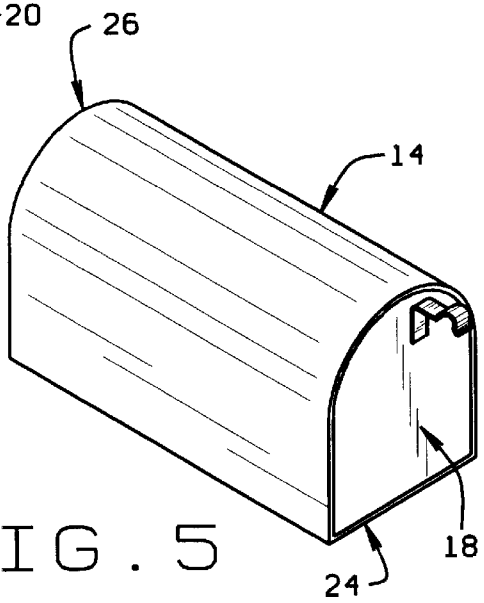
FIG. 5 shows a mailbox liner having a mailbox insert within the liner.

The mailbox insert 16 of the present invention can be a complete mailbox as is known in the art or any portion thereof. In the preferred embodiment, the mailbox insert 16 includes a door 18 pivotally mounted at one end of the mailbox insert 16. All that is required is that the mailbox liner 14 and mailbox insert 16 be adapted to one another so that the mailbox insert 16 can be removably attached within the mailbox liner 14 as shown in FIG. 5.

In the preferred embodiment, the mailbox liner 14 is made of sheet metal and has a flat bottom portion 24 made from a single piece of sheet metal and a unshaped top portion 26 made from a second piece of sheet metal, bent to form the u-shape and riveted to the bottom portion 24. The mailbox liner 14 of the preferred embodiment has a length 28 is 17 inches long, a width 30 which is 7 inches and a height 32 which is 9 inches. This size and shape allows the use of readily available mailboxes as the mailbox insert 16 in the masonry mailbox assembly 10 of the present invention. The mailbox insert shown in FIGS. 1 and 2 is a complete mailbox of standard shape and size as is known in the art. By adapting the mailbox liner 14 to accept readily available complete mailboxes as the mailbox insert 16, the replacement of the mailbox insert 16 is easier completed.

When building the masonry mailbox assembly 10 of the present invention, the mailbox liner 14 is used in place of the complete mailbox which is used in the art. Thus, as is standard in the art, one constructs the mailbox from the base and at or near the upper portion of the masonry shell 12 the mailbox liner 14 is inserted and the masonry shell 12 is built around and encases the mailbox liner 14. At any point during this process, the mailbox insert 16 can be inserted into the mailbox liner 14. If desired, the mailbox insert 16 can be connected to the mailbox liner 14 using screws, bolts, clips or any other equivalent fastener which secures the mailbox insert 16 within the mailbox liner 14 but which also allows the later removal of the mailbox insert 16, as shown in FIG. 5. It shou.d be apparent to one skilled in the art that the fastener may be attached at any suitable location.

Figure 6:
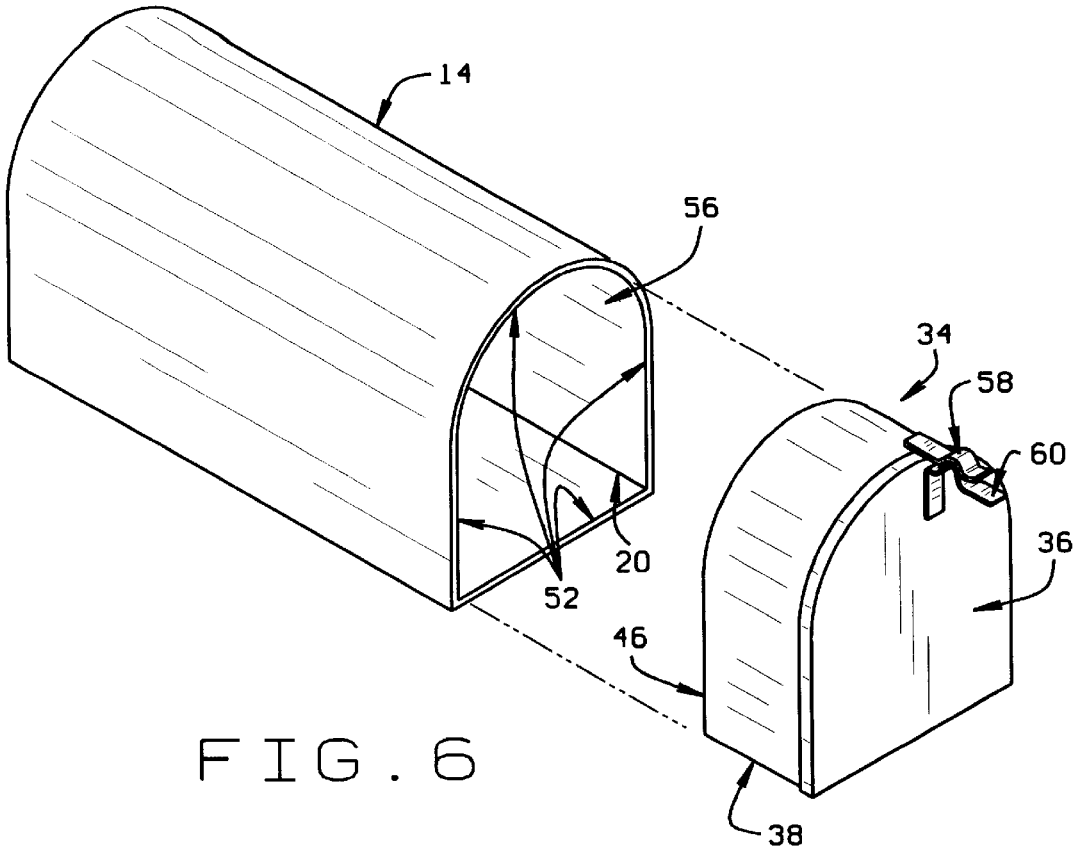
FIG. 6 shows an exploded view of the mailbox liner and mailbox face of the present invention.
Figure 7:
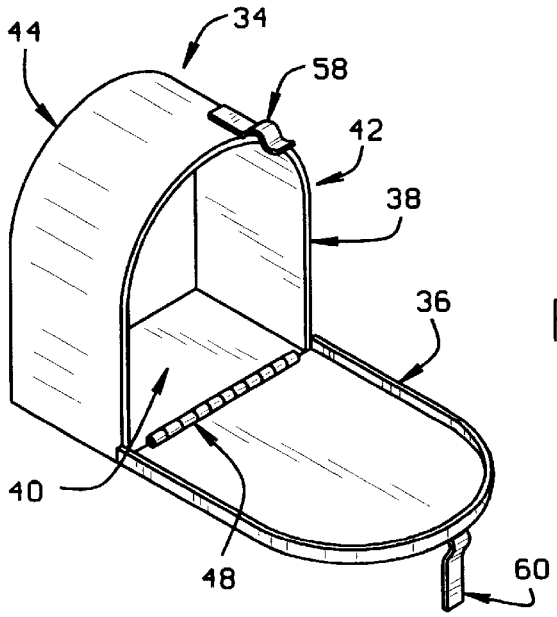
FIG. 7 shows the mailbox face of the present invention having a door pivotally attached in the open position.

An alternative embodiment of the present invention is shown in FIGS. 6 and 7. The mailbox liner 14 is substantially identical to the mailbox liner 14 of the first embodiment described above. However, in a further improvement of the present invention, the complete mailbox insert 16 is replaced with a mailbox face 34. The mailbox face is used to convert the mailbox liner into an operational mailbox without the need for a full mailbox insert 16.

The mailbox face 34 comprises a door 36 pivotally attached to a flange 38 the flange 38 has a width 39 and a length 41. The mailbox face 34 defines a first opening 40 at a first end 42 and a second opening 44 at a second and opposite end 46. In the preferred embodiment, the door 36 is pivotally mounted to the flange 38 with a hinge 48 at the first end 42 and the door 36 is movable between an open position (FIG. 7) to a closed position (FIG. 6). In the preferred embodiment, the exterior circumference of the flange 38 at the second opening 44 is slightly smaller interior circumference 52 of the mailbox liner 14 so that the second end 44 of the mailbox face 34 can be disposed within an opening 56 of the mailbox liner 14 as discussed above. The mailbox face 34 can also be adapted to be disposed around the mailbox liner 14 as an alternate attachment.

The mailbox face 34 also has means for holding the door 36 in a closed position. In the preferred embodiment, the means comprises a first clip 58 attached to the first end of the flange 38 and a second clip 60 attached to the door 36. The first and second clips 58 and 60 provide a frictional engagement when the door 36 is moved from the first position to the second position thereby securing the door 36 in its closed position. Any equivalent means that would allow the door 36 to be secured in the closed position would be suitable.

The mailbox face 34 of the present invention can be used to retrofit an existing mailbox which has a lost or damaged door (not shown) or used in conjunction with the masonry mailbox assembly 10 of the present invention in place of the mailbox insert 16. In addition, the mailbox face 34 of the present invention could be used with an existing masonry mailbox without a mailbox liner 14. The mailbox face need only be adapted to fit within the opening on an existing mailbox and the flange 38 inserted into the opening and secured thereto. in addition, a decorative lip can be added to the first end 42 to hide any gap between the mailbox flange and a mailbox liner or existing masonry mailbox opening upon installation. Also, two mailbox faces could be attached with a mailbox liner to thereby provide a dual access mailbox.

While the present invention has been described by reference to specific embodiments, and particular uses, it should be understood that modifications and variations of the invention may be constructed, and different uses of the invention may be made, without departing from the scope of the invention in the following claims.

What is claimed is:

1. A masonry mailbox assembly comprising:

a masonry shell;

a mailbox liner encased within and permanently secured to the masonry shell;

a mailbox insert having a door Pivotally attached thereto, the mailbox insert removably connected within the mailbox liner whereby the mailbox insert can be replaced without dismantling the masonry shell, and wherein the mailbox liner is substantially the same shape as the mailbox insert.

2. The masonry mailbox assembly of claim 1 further comprising means for securing the mailbox insert within the mailbox liner.

3. The masonry mailbox assembly of claim 1 wherein the masonry shell comprises brick and mortar.

4. The masonry mailbox assembly of claim 1 wherein the mailbox liner is adapted to prevent the masonry shell from adhering to the mailbox insert.

5. The masonry mailbox assembly of claim 1 wherein the mailbox insert is substantially the same length as the mailbox liner.

6. The masonry mailbox assembly of claim 1 wherein the mailbox insert has a length and a width and the mailbox insert length is no greater than 50 percent of the mailbox insert width.

7. The masonry mailbox assembly of claim 1 wherein the mailbox liner substantially separates the entirety of the mailbox insert from the masonry shell.

8. The masonry mailbox assembly of claim 1 wherein the mailbox insert comprises a completely assembled mailbox.

9. The masonry mailbox assembly of claim 1 wherein the mailbox insert door is pivotally mounted to a flange.

10. The masonry mailbox assembly of claim 9 wherein the flange is disposed around the exterior of an opening on the mailbox liner.

11. The masonry mailbox assembly of claim 9 wherein the flange is disposed within the interior of an opening of the mailbox liner.

12. A method of building a masonry mailbox, comprising the steps of:

encasing and permanently securing a mailbox liner within a masonry shell; and placing a mailbox insert having a door pivotally attached thereto within the mailbox liner, wherein the mailbox liner is substantially the same shape as the mailbox insert.

13. The method of claim 12 wherein the mailbox liner substantially prevents the mailbox insert from adhering to the masonry shell.

14. The method of claim 12 wherein the mailbox insert door is pivotally mounted to a flange.

15. The method of claim 12 wherein the masonry shell is made from brick and mortar.

16. In combination, a mailbox face for use with a mailbox, the combination comprising: the mailbox having an opening without a door, the mailbox face comprising a mailbox door pivotally mounted to a flange, the flange having a first opening at a first end of the flange and a second opening at an opposite second end of the flange, the door being pivotally mounted at the first end of the flange, and the second end of the flange being inserted within the opening of the mailbox.

17. The combination of claim 16 wherein the flange defines the first opening having a width and a flange length is no greater than 50 percent of the opening width.

18. The combination of claim 16 wherein the circumference of the first opening is larger than the circumference of the second opening.

19. A method of repairing a mailbox encased in a masonry shell and which has no door, thus exposing an opening into the mailbox, the method comprising:

providing a mailbox face having a mailbox door pivotally connected to a flange;

positioning the flange of the mailbox face inside the opening into the mailbox; and securing the flange to the mailbox.

* * * * *